United States Patent [19]

Myers

[11] 4,015,847

[45] Apr. 5, 1977

[54] PINBALL SPORTS COMPLEX

[76] Inventor: Stephen B. Myers, 413 Crest Road, Oreland, Pa. 19075

[22] Filed: Mar. 25, 1976

[21] Appl. No.: 670,451

[52] U.S. Cl. ..... 273/121 R; 273/88; 273/94 R

[51] Int. Cl.[2] ..... A63F 7/06

[58] Field of Search ..... 273/88, 94 R, 118–128, 273/93 R

[56] References Cited

UNITED STATES PATENTS

| | | | |
|---|---|---|---|
| 447,851 | 3/1891 | Wachter | 273/119 R X |
| 734,313 | 7/1903 | Frank | 273/123 R X |
| 1,093,764 | 4/1914 | Brown | 273/119 R X |
| 1,600,624 | 9/1926 | DeBoer | 273/119 R |
| 1,669,762 | 5/1928 | Kauppinen | 273/121 R |
| 1,730,523 | 10/1929 | Nicholas | 273/121 R |
| 2,631,854 | 3/1953 | Volman | 273/119 A X |
| 2,722,423 | 11/1955 | Sire | 273/126 R X |
| 2,933,316 | 4/1960 | Mancini | 273/93 R |
| 3,425,696 | 2/1969 | Dockum | 273/126 R |
| 3,433,484 | 3/1969 | Wallenmeyer | 273/120 R X |
| 3,606,330 | 9/1971 | Chapman | 273/94 R |
| 3,764,139 | 10/1973 | Cohen | 273/88 |
| 3,941,381 | 3/1976 | Trbovich | 273/121 R X |

*Primary Examiner*—Richard J. Apley
*Attorney, Agent, or Firm*—Smith, Harding, Earley & Follmer

[57] ABSTRACT

A sports complex of the pinball type which simulates a variety of games including baseball, ice hockey, football, golf, skiball, and blackjack, comprising a game board having wall means extending around peripheral portions to define a field of play, or playing field, in which a ball is confined, and a plurality of passageways formed on the upper surface of the game board so that when the ball is introduced to the upper end of the game board and the game board is in an inclined position, the ball moves by gravity through the passageways from the upper to the lower end of the playing field. The passageways include a plurality of intersections where the ball may take alternative paths. A cover is mounted above the passageways to extend across a portion of the playing field and has openings located therein above various intersections and aligned with the alternative paths at the intersections. There are provided a plurality of defensive players, each of which includes a pin adapted to be extended through the openings in the cover into the alternative paths to block the movement of the ball. Various covers are provided for various games. In playing a game, the defensive players may be positioned at selected openings in an effort to block the movement of the ball from the upper to the lower end of the playing field.

12 Claims, 18 Drawing Figures

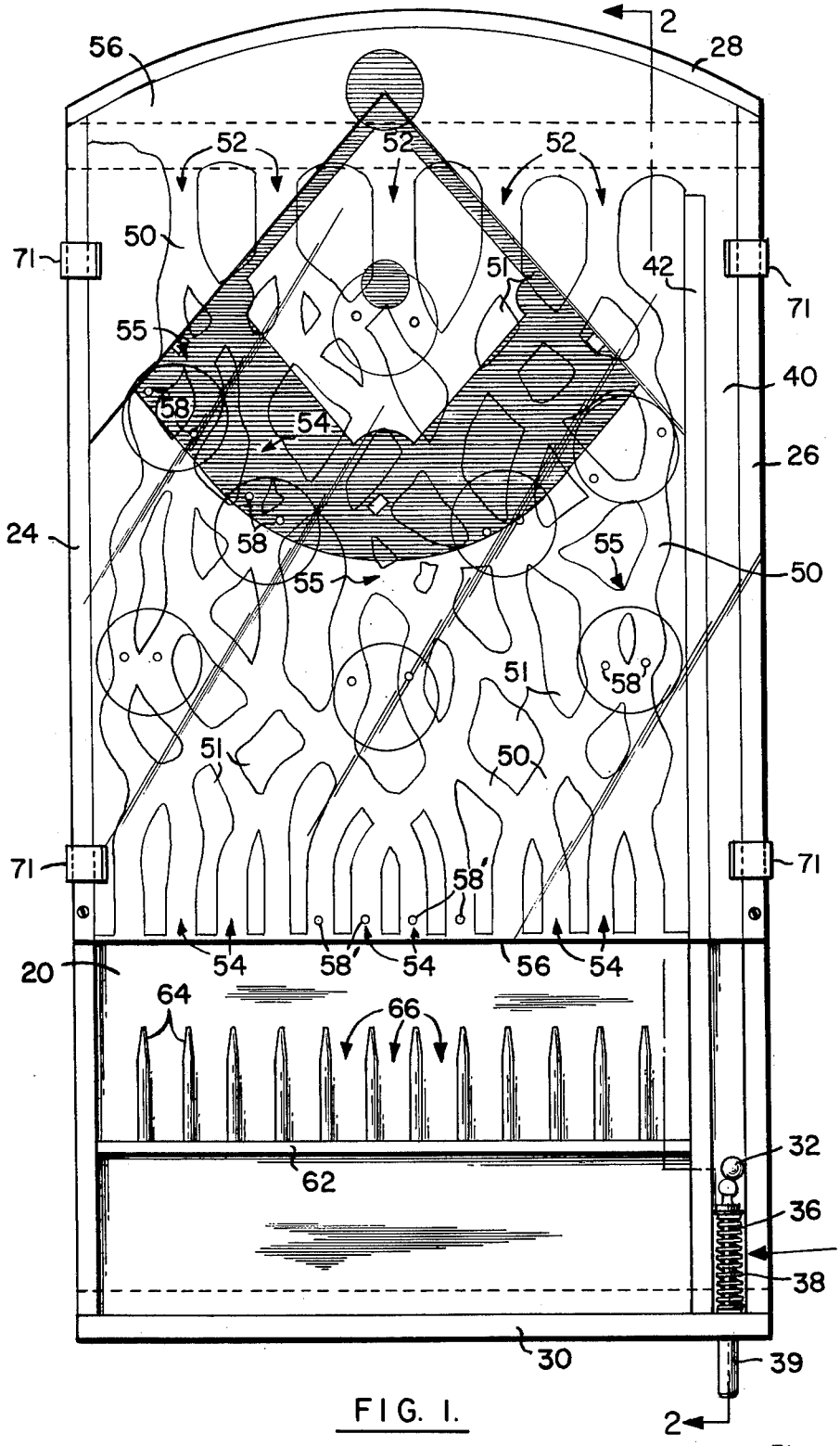
FIG. 1.
FIG. 2.
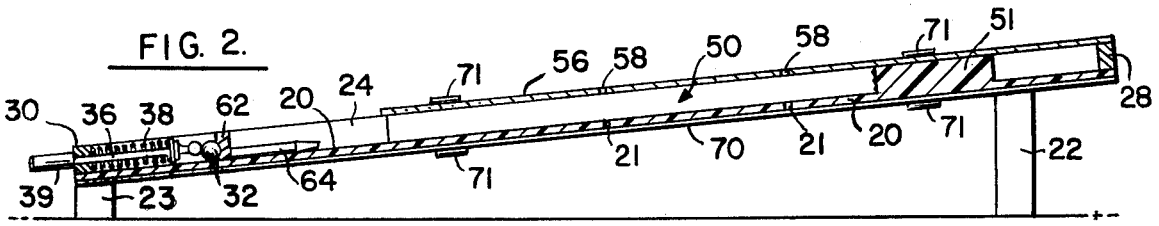

FIG. 3.
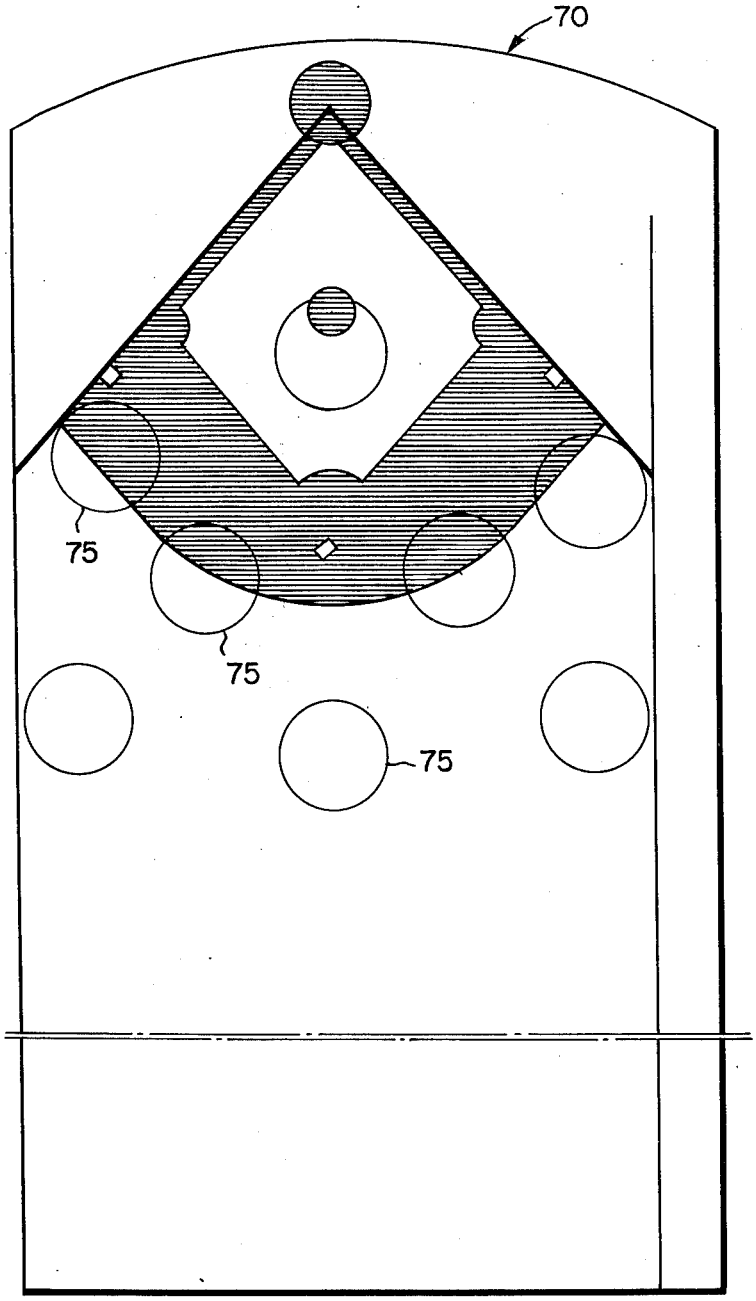
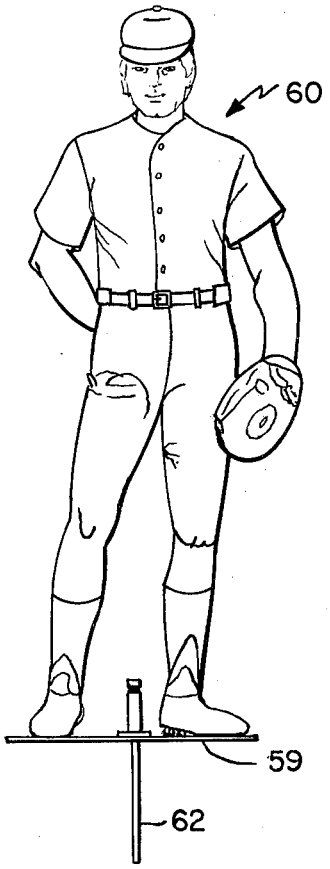
FIG. 5.
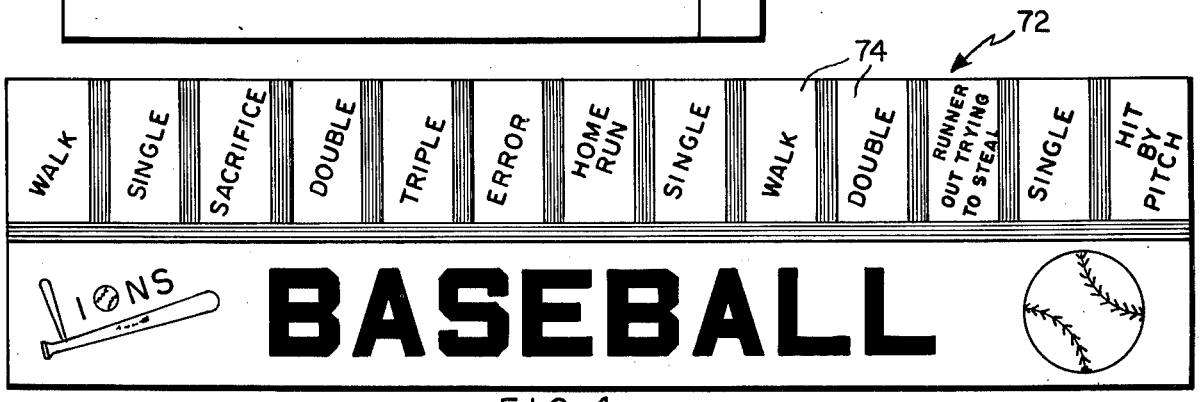
FIG. 4.

86

| | | | 88 | 88 | | | | 88 | 98 | | | |
|---|---|---|---|---|---|---|---|---|---|---|---|---|
| | | | | | YARDS GAINED ← 89 | | | | | | | |
| FUMBLE | 5 | 10 | +10 PENALTY | 10 | 15 | 20 | 15 | 10 | +15 PENALTY | 10 | 5 | INTERCEPTION |
| | | | | | FIELD GOAL ← 89 | | | | | | | |
| WIDE | 5 | 15 | 25 | 35 | 45 | 50 | 45 | 40 | 30 | 20 | 10 | WIDE |
| | | | | | BLOCKERS ← 89 | | | | | | | |
| 1 | 1 | 1 | 2 | 2 | 2 | 2 | 2 | 2 | 2 | 1 | 1 | 1 |
| | | | | | PUNTS | | | | | | | |
| 20 | 40 | 35 | 45 | 40 | 50 | 60 | 45 | 40 | 45 | 40 | 35 | 20 |
| | | | | | PUNT RETURN YARDAGE | | | | | | | |
| 0 | 5 | 0 | 10 | 0 | 15 | 30 | 15 | 0 | 10 | 0 | 5 | 0 |
| | | | | | KICKOFFS | | | | | | | |
| 20 | 10 | GOAL LINE | GOAL LINE | 5 | 10 | OUT OF END ZONE | 10 | 5 | GOAL LINE | GOAL LINE | 10 | 20 |
| | | | | | KICKOFF RETURN YARDAGE | | | | | | | |
| 10 | 20 FUMBLE | 30 | 25 | 40 | 15 | 50 | 25 | 30 | 20 | 35 | 20 | 10 |
| | | | | | INTERCEPTION ← 89 | | | | | | | |
| 0 | 5 | 0 | 10 FUMBLE | 10 | 20 | RUNBACK TD | 15 | 10 | 20 FUMBLE | 0 | 5 | 0 |
| | | | | | FUMBLE | | | | | | | |
| DEFENSE | OFFENSE | DEFENSE | OFFENSE | DEFENSE | OFFENSE | OUT OF BOUNDS | DEFENSE | OFFENSE | DEFENSE | OFFENSE | DEFENSE | OFFENSE |
| | | | | | PENALTY AGAINST | | | | | | | |
| OFF- 15 | DEF- 5 | OFF- 5 | DEF- 15 | OFF- 15 | DEF- 5 | OFF SETTING PENALTY | OFF- 5 | DEF- 15 | OFF- 15 | DEF- 5 | OFF- 5 | DEF- 15 |
| | | | | | EXTRA POINT | | | | | | | |
| WIDE | GOOD | GOOD | GOOD | GOOD | GOOD | GOOD | GOOD | GOOD | GOOD | GOOD | GOOD | WIDE |

FIG. 10.

| HOLE | YARDS | PAR |
|---|---|---|
| 1 ST | 360 | 4 |
| 2 ND | 430 | 5 |
| 3 RD | 150 | 3 |
| 4 TH | 490 | 5 |
| 5 TH | 380 | 4 |

| HOLE | YARDS | PAR |
|---|---|---|
| 6 TH | 350 | 4 |
| 7 TH | 130 | 3 |
| 8 TH | 390 | 4 |
| 9 TH | 370 | 4 |
| TOTAL | | 36 |

| HOLE | YARDS | PAR |
|---|---|---|
| 10 TH | 380 | 4 |
| 11 TH | 140 | 3 |
| 12 TH | 420 | 5 |
| 13 TH | 370 | 4 |
| 14 TH | 170 | 3 |

| HOLE | YARDS | PAR |
|---|---|---|
| 15 TH | 480 | 5 |
| 16 TH | 340 | 4 |
| 17 TH | 400 | 4 |
| 18 TH | 350 | 4 |
| TOTAL | | 36 |

PINBALL SPORTS COMPLEX

BACKGROUND OF THE INVENTION

The invention relates to a game apparatus of the pinball type in which the playing of various sports and number games may be simulated. Games of the pinball type are known, and are illustrated by the games shown in U.S. Pat. Nos. 492,178; 734,313; 1,530,035; 1,945,798; and 2,230,834. However, the prior art games lack several desirable features. They lack the flexibility to play a plurality of different sport games. Also, such games lack the element of permitting a player to use his knowledge of a particular sport to assist his strategy in the playing of the game.

SUMMARY OF THE INVENTION

It is an object of the invention to provide a game apparatus of the pinball type in which various sports games can be played by simulation, and which involve the use of skill, strategy and chance.

Another object of the invention is to provide a game apparatus of the pinball type in which defensive players may be positioned at various alternative locations to block the movement of the ball through the field of play, thereby providing an extra dimension to a pinball type of game.

A further object of the invention is to provide a game apparatus of the pinball type which is suited for use by both young and old, and in which the young may compete with the old.

A still further object of the invention is to provide a pinball type of apparatus in which parts may be interchanged so as to provide simulated games of baseball, footbal, hockey, golf and number games.

Briefly stated, the game apparatus in accordance with the invention comprises a game board, a ball, wall means extending around peripheral portions of the game board to define a field of play in which the ball is confined, means on the upper surface of the game board defining a plurality of passageways for the ball extending from the upper to the lower end of the field of play, the game board being adapted to be set in an inclined position and the passageways including a plurality of intersections where the ball may take alternative paths, means for propelling the ball into the upper end of the field of play so that the ball may move by gravity through the passageways to the lower end, a cover mounted on the wall means to extend across the field of play in the area provided with the alternative paths, the cover having openings aligned with the alternative paths, and a plurality of defensive players each of which includes a pin adapted to extend through the openings in the cover to block the alternative paths beneath the associated opening so that a ball moving through this path is arrested. At the lower end of the field of play, there are provided a row of slots for receiving and holding a ball which has passes through the field of play. A slot card is adapted to be positioned adjacent to and extending along the row of slots and has marked areas adapted for alignment with the slots to indicate various values or events assigned to each slot so that when a ball enters a particular slot during the playing of a game, the player receives credit for the assigned value or event indicated by the aligned marked area of the slot card.

BRIEF DESCRIPTION OF THE DRAWINGS

FIG. 1 is a top plan view of the game apparatus in accordance with the invention set up for the playing of a simulated game of baseball;

FIG. 2 is a section taken on line 2—2 of FIG. 1;

FIG. 3 is a top plan view of a baseball field card;

FIG. 4 is a top plan view of a baseball slot card;

FIG. 5 is a view in elevation of a baseball defensive player;

FIG. 10 is a top plan view of a football slot card;

DESCRIPTION OF THE PREFERRED EMBODIMENT

Figure 6:
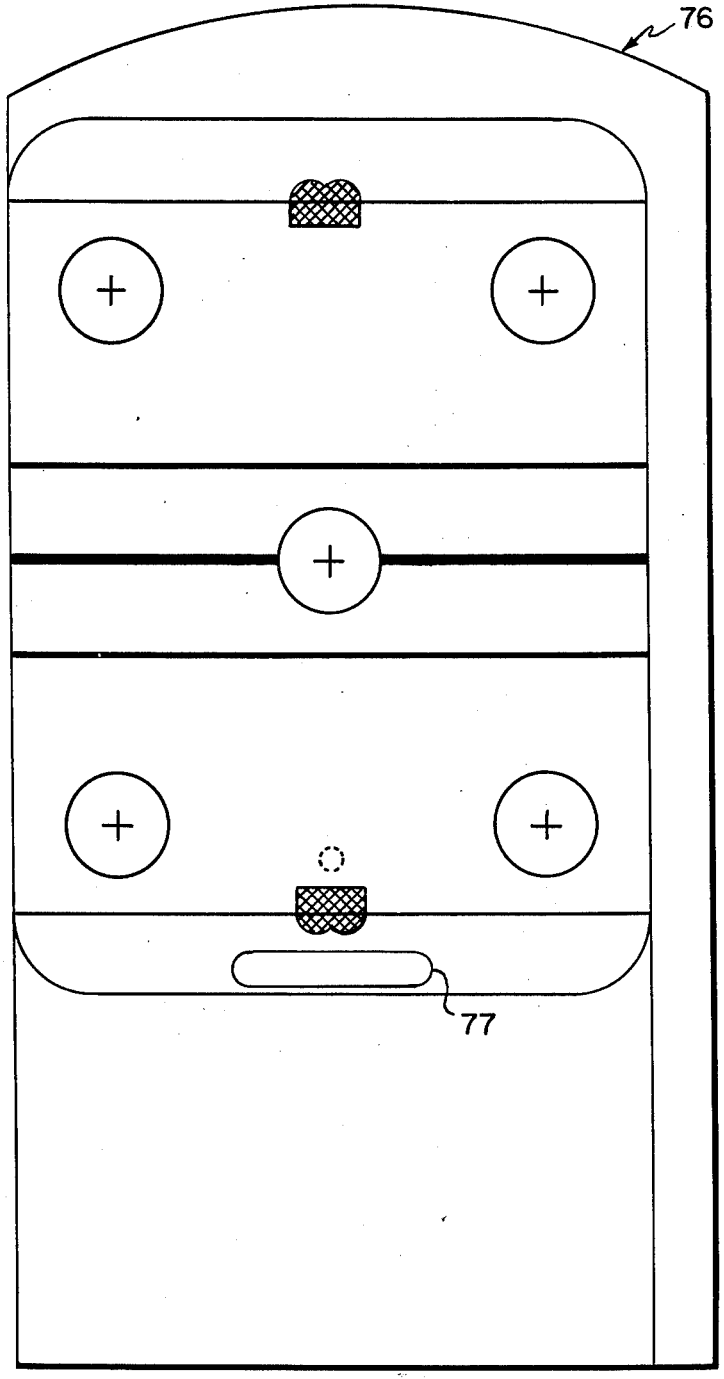
FIG. 6 is a top plan view of a hockey field card.

Although specific terms are used in the following description for clarity, these terms are intended to refer only to the structures shown in the drawings and are not intended to define or limit the scope of the invention.

Turning now to the specific embodiments of the invention selected for illustration in the drawings, FIGS. 1 and 2 show a game apparatus in accordance with the invention comprising a game board 20 of generally rectangular configuration having wall means mounted thereon extending around peripheral portions thereof and projecting upwardly from the top thereof to enclose a field of play in which a ball 32 is confined. The game board 20 is adapted to be set in an inclined position with one end of the playing field raised higher than the other end, there being provided a pair of support members 22 and 23 adapted to be positioned at the upper and lower ends of the game board 20 to support it in the inclined position as best shown in FIG. 2. The game board 20 has a pair of straight sides, a straight lower end and an arcuate upper end. The wall means is comprised of a pair of side strips 24 and 26 extending along the straight sides of the game board 20, an arcuate strip 28 extending along the upper arcuate edge of the game board 20, and a strip 30 extending along the lower edge of the game board 20. Preferably the strips forming the wall means are about ¾ inches high.

Means are provided for propelling a ball 32 into the upper end of the field of play. Such means comprises a spring biased plunger 34 comprising a plunger member 36 and a compressible spring 38. Plunger member 36 extends through strip 30 and is provided with a knob 39 which can be manually pulled to cause the plunger member 36 to compress spring 38 so that on the release of knob 39, the plunger member 36 is responsive to the expansion of the spring 38 to propel the ball 32 along a guideway 40 formed between side leg 26 and an elongated leg 42 extending in parallel spaced relationship relative to leg 26.

Means are provided on the upper surface of the game board 20 to define a plurality of ball passageways 50 extending from the upper to the lower end of the playing field. The passageways 50 are formed by raised portions 51 on the upper surface of the game board 20 to provide intersecting passageways in the configuration as illustrated in FIG. 1. The game board 20 with the raised portions 51 may be made of a single mold of clear plastic. The passageways 50 are formed to provide a plurality of entrances 52, i.e. five, at the upper end of the field of play and a plurality of exits 54, i.e. 12, at the lower end of the field of play. Preferably, there are provided more exits 54 than there are entrances 52 as shown in FIG. 1.

The passageways 50 are also formed to provide a plurality of intersections 55 where the ball 32 may take alternative paths as it moves downwardly from the upper to the lower end of the playing field. Typically, a ball 32 moving from the upper to the lower end of the field through the passageways 50 must pass through six intersections 55 where it can take alternative paths.

A cover 56 is mounted on the top of the side legs 24 and 26 and extends therebetween and across the portion of the field of play provided with the raised portions 51. The cover 56 and the game board 20 are both made of the same transparent material, such as a clear plastic. The cover 56 is provided with a plurality of bores or openings 58 which are located at various intersections 55 as is best shown in FIG. 1. The openings 58 at each of the intersections 55 are aligned with the passageways 50 of the alternative paths at such intersections 55. The game board 20 is provided with bores or openings 21 aligned with each of the openings 58 on the cover 56.

The game apparatus includes a plurality of defensive players such as the baseball player 60 shown in FIG. 5. The defensive player 60 is provided with a pin 61 extending from a base 59 and adapted to extend through the openings 58 a sufficient distance to extend into the alternative paths provided at each intersection 55 and into the aligned opening 21 to block and arrest the movement of the ball 32 through the selected path. To this end, each pair of aligned openings 58 and 21 is set back from the dividing end of a raised portion so as to catch a ball in the associated passageway 50 as is shown in FIG. 1. This function is important to the playing of various games as will be apparent hereafter.

At the lower end of the field there is provided means for providing a row of slots for receiving and holding a ball which has passed through the playing field, such means comprising an elongated leg 62 extending across the lower end of the field between the strips 24 and 42 and a plurality of short legs 64 providing a plurality of partitions extending transversely to the leg 62 and toward the upper end of the field. The partition legs 64 define a plurality, i.e., 13, pockets or slots 66 into which a ball 32 is received and held after it has passed through the playing field.

The game apparatus is provided with a plurality of field cards adapted to be positioned on the underside of the game board 20 and provided with markings illustrative of the field on which a particular game is played. In FIG. 3 there is shown a field card 70 for playing a simulated game of baseball. This field card 70 is provided with markings illustrative of a baseball field with a baseball diamond including a pitcher's mound, bases, and an outfield area. The field cards are positioned on the underside of the transparent game board 20 as shown in FIGS. 1 and 2 with the marked area visible from the top of the game board 20. The field card is held in position by means of four C-clamps 71 appropriately located around the periphery of the game board 20.

The baseball field card 70 is also provided with circular markings 75 at eight locations as is apparent from FIG. 3. The circular markings 75 are positioned so as to register with eight pairs of the openings 58 in the cover 56 as is apparent from a consideration of FIG. 1 wherein the baseball field card is positioned on the underside of the game apparatus. The circular markings 75 are used in the playing of a simulated game of baseball to indicate to the pairs of alternative positions for the defensive baseball players.

The game apparatus is provided with a plurality of slot cards adapted to be positioned adjacent to the row of slot 66 in the region between legs 62 and lower strip 30. In FIG. 4 there is shown a slot card 72 for use in playing a simulated game of baseball. The slot card 72 is provided with thirteen marked areas 74 for alignment with the thirteen slots 66, and for indicating various events associated with the game of baseball. Accordingly, when the ball 32 enters a particular slot 66 during the playing of a game, the player receives credit for the event indicated in the marked area 74 of the slot card 72. As shown in FIG. 4, the marked areas 74 indicate various types of hits and outs that occur during the playing of a baseball game.

A number of defensive baseball players 60, one for each circle 75, are provided. The pin 62 of each defensive player 60 extends through the cover openings 58 to block the movement of the ball through various of the alternative paths at the intersections 55. The defensive position is chosen by the defensive operator of the game before the offensive operator shoots the ball 32.

In FIG. 6 there is shown a field card 76 for the playing of a simulated game of ice hockey. The field card 76 is provided with markings illustrative of a hockey rink including goal and face off areas. The field card 76 is provided with an oval-shaped marking 77 which is adapted to register with four openings 58' which receive a pin 83 of a defensive player 82 in the same manner as the openings 58.

Figure 7:
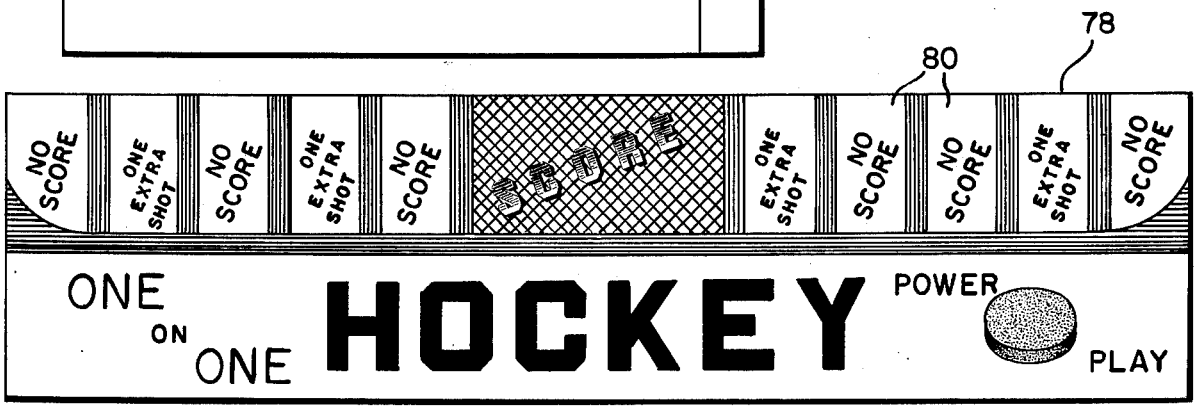
FIG. 7 is a top plan view of a hockey slot card.

In FIG. 7 there is shown a slot card 78 for use in playing the simulated game of ice hockey. The slot card 76 is provided with marked areas 80 to indicate various events which occur during the playing of an ice hockey game. These marked areas 80 indicate the events of "SCORE", "NO SCORE", and "ONE EXTRA SHOT" as is apparent in FIG. 7. The central portion of the slot card 76 to be aligned with the three central slots 16 indicate the most desirable event, i.e., "SCORE".

Figure 8:
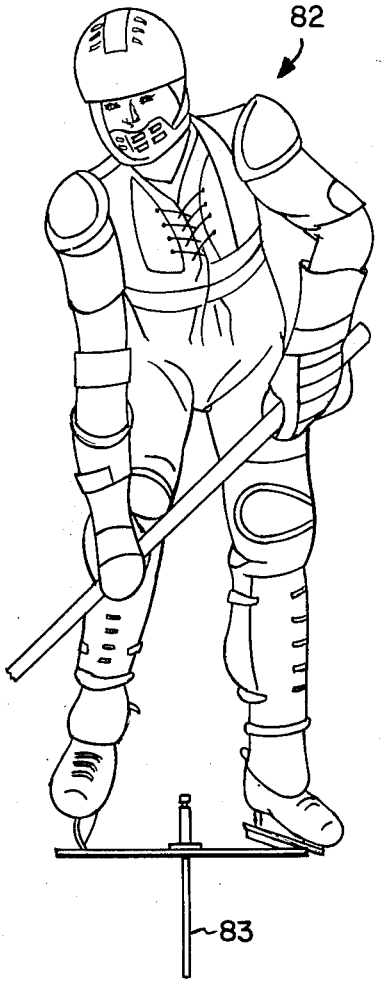
FIG. 8 is a view in elevation of a hockey defensive player.

In FIG. 8 there is shown defensive hockey player 82 provided with a pin 83 to be extended through the cover openings 58' to block the movement of the ball 32 through various of the exits 54.

Figure 9:
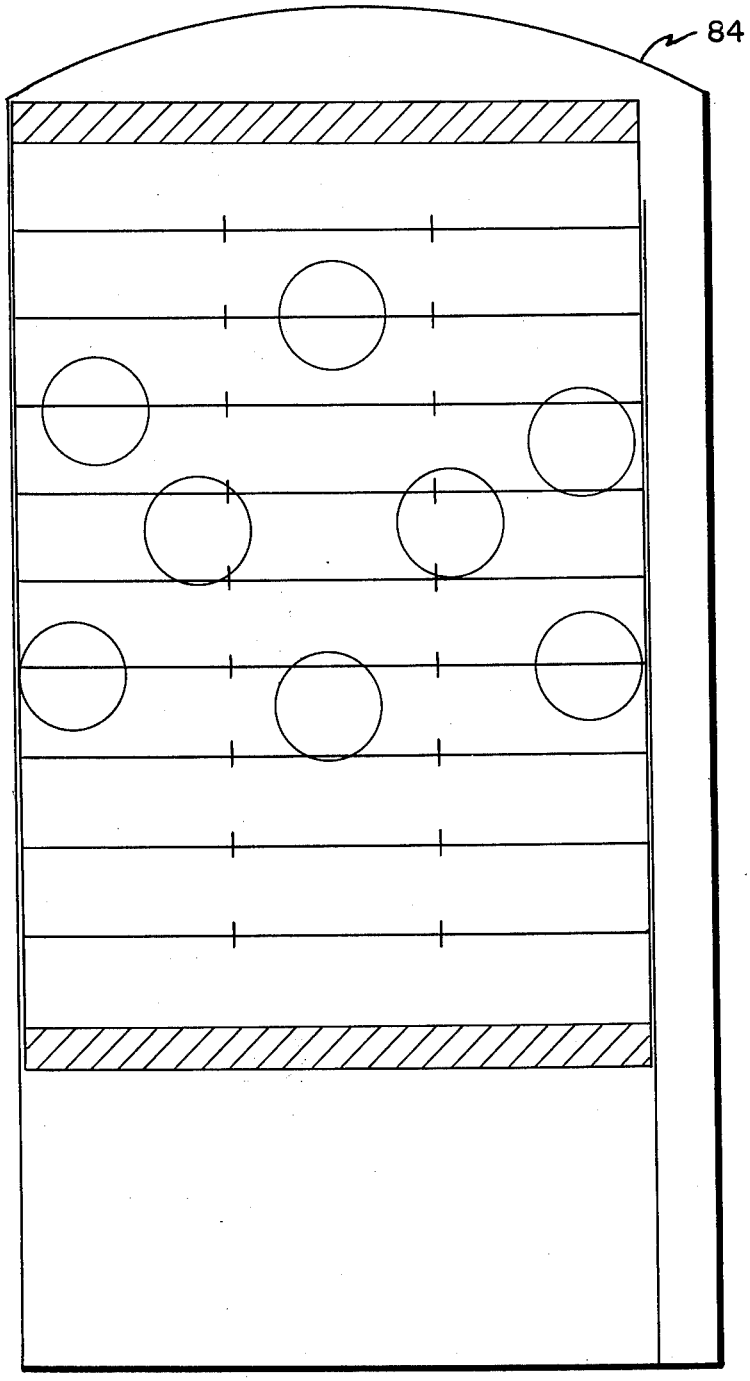
FIG. 9 is a top plan view of a football field card.

In FIG. 9 there is shown a field card 84 for playing a simulated game of football. The field card 84 is provided with markings illustrative of a football field including simulated yard lines and eight circle markings 85 adapted to register with pairs of openings 58 in cover 56.

In FIG. 10 there is shown a slot card 86 for use in playing a simulated football game. The slot card 86 is provided with marked areas 88 divided into 13 vertical columns adapted to be aligned with the 13 slots 66 and 11 horizontal lines. The horizontal lines are associated with markings 89 indicating various football related events. The marked areas 88 in the 13 columns relate to values to be credited to the events recited in the markings 89. Thus, when the ball 32 enters one of the slots above one of the vertical columns, the player is credited with the value set forth in this column in the horizontal line associated with the event of interest set forth in the markings 89.

Figure 11:
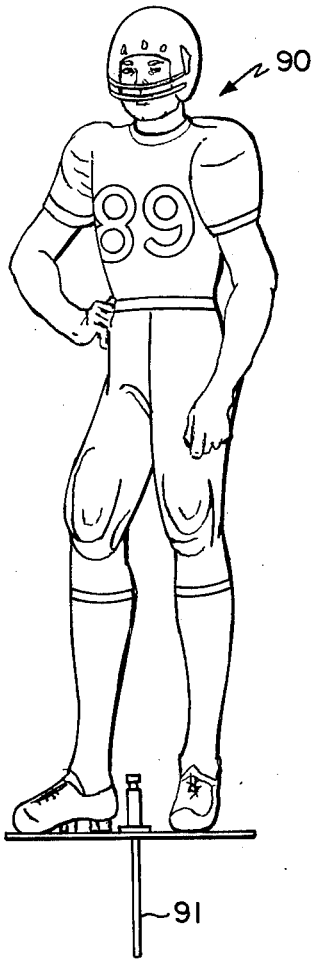
FIG. 11 is a view in elevation of a football defensive player.

A defensive football player 90 is shown in FIG. 11, and is provided with a pin 91 adapted to be extended through the cover openings 58 to block the movement of the ball 32 through various of the alternative paths at the intersections 55.

Figure 12:
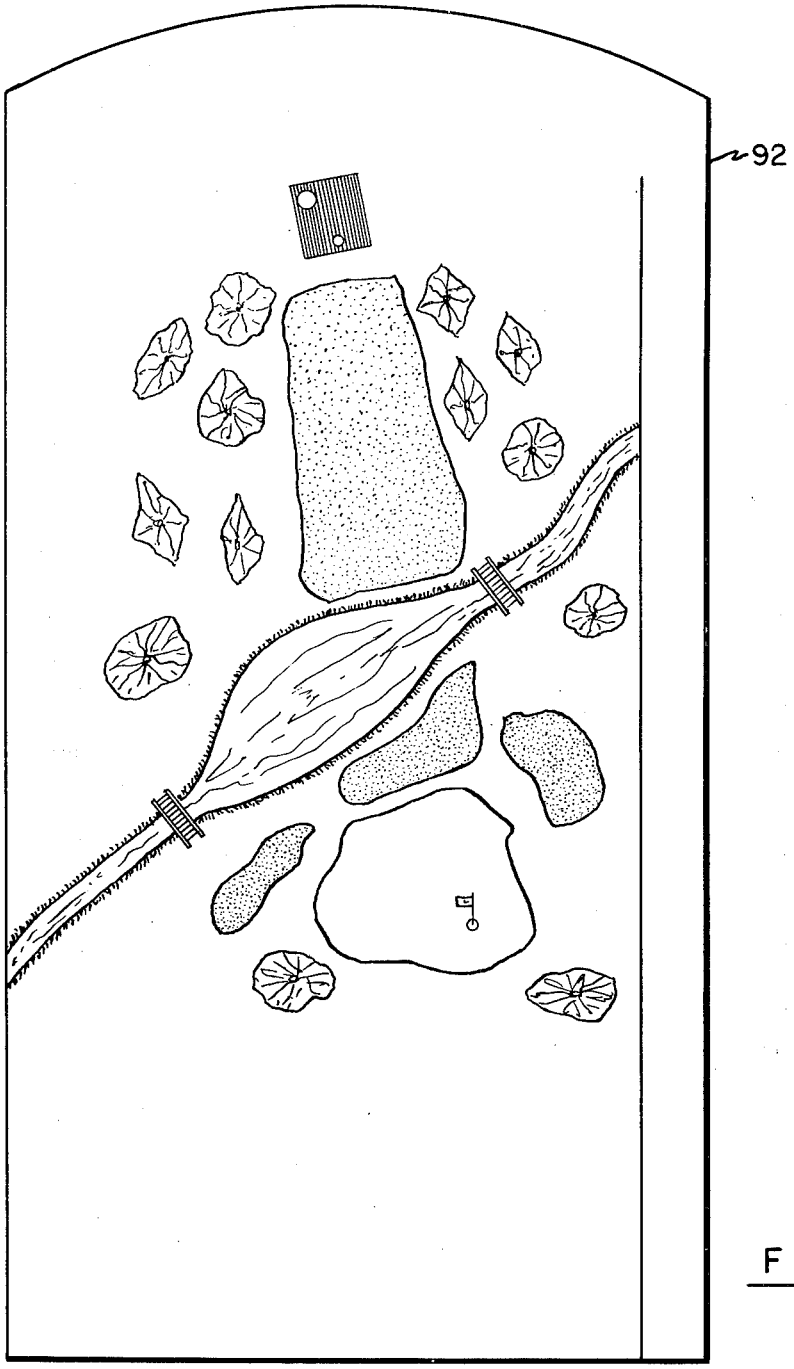
FIG. 12 is a top plan view of a gold field card.

In FIG. 12 there is shown a field card 92 for the playing of a simulated golf game. Card 92 is provided with markings illustrative of a golf course including a tee area and a green area, for example.

Figure 13:
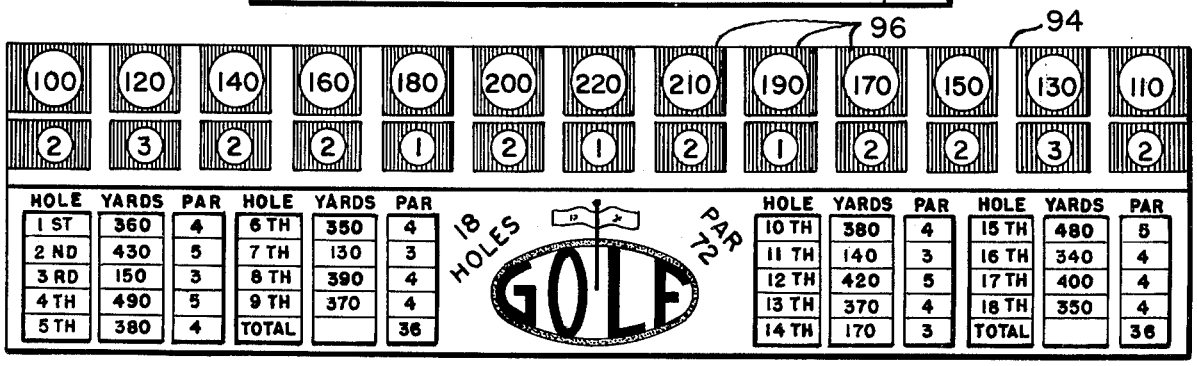
FIG. 13 is a top plan view of a golf slot card.

In FIG. 13 there is shown a slot card 94 for use in playing the simulated golf game. Slot card 94 is provided with 13 marked areas 96 for alignment with the 13 slots 66 to indicate various distances achieved in a golf shot and a number of putts. The lower portion of the slot card 92 is provided with the distance yardage and the par value for 18 holes of a golf course which is used in the playing of the simulated golf game.

Figure 14:
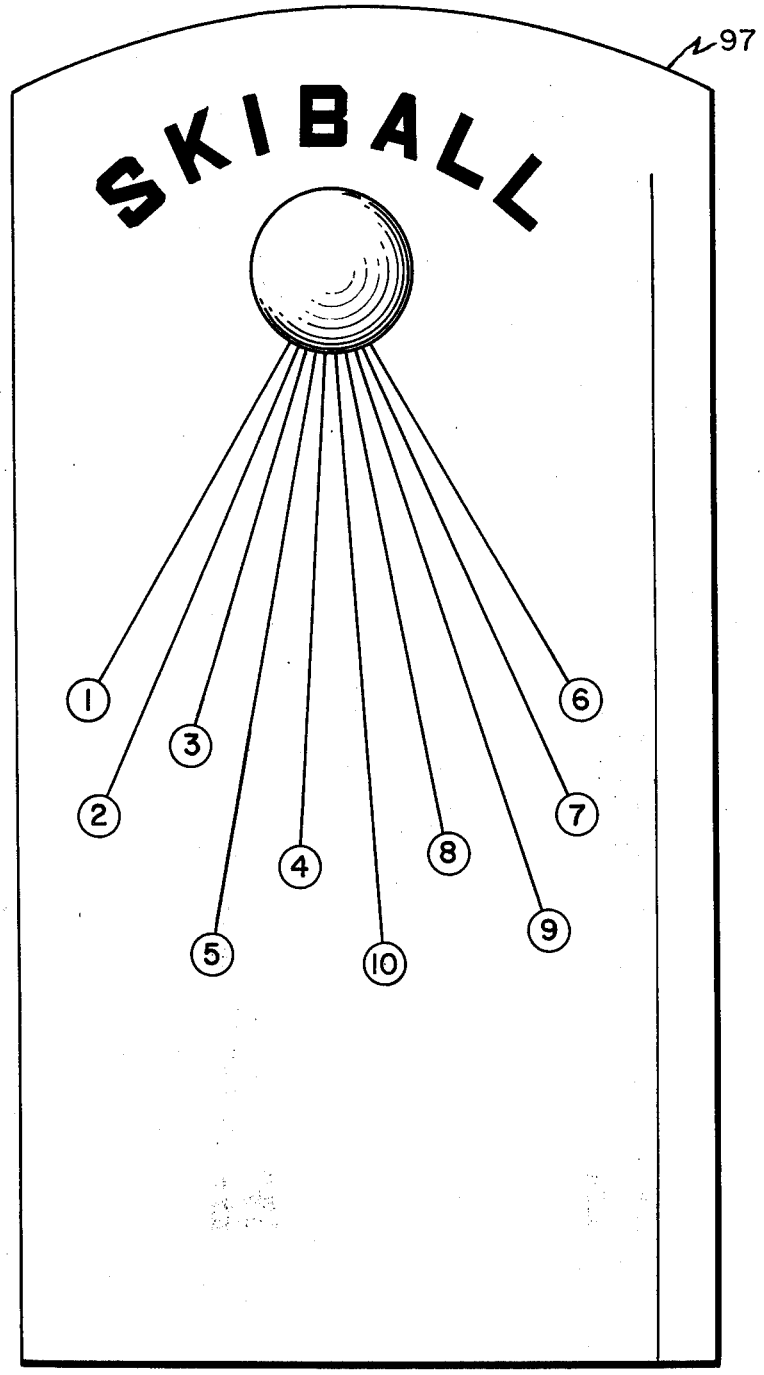
FIG. 14 is a top plan view of a skiball field card.
Figure 15:
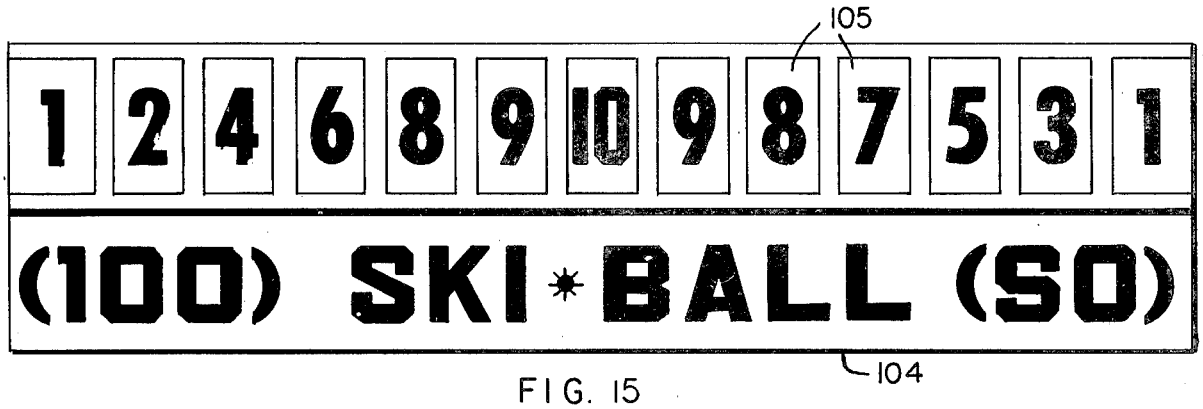
FIG. 15 is a top plan view of a skiball slot card.

In FIG. 14 there is shown a field card 97 for use in playing a simulated game of skiball and in FIG. 15 there is shown a field card 99 for use in playing a simulated game of blackjack, each of the cards 97 and 99 being provided with markings illustrative of the games of skiball and blackjack.

Figure 16:
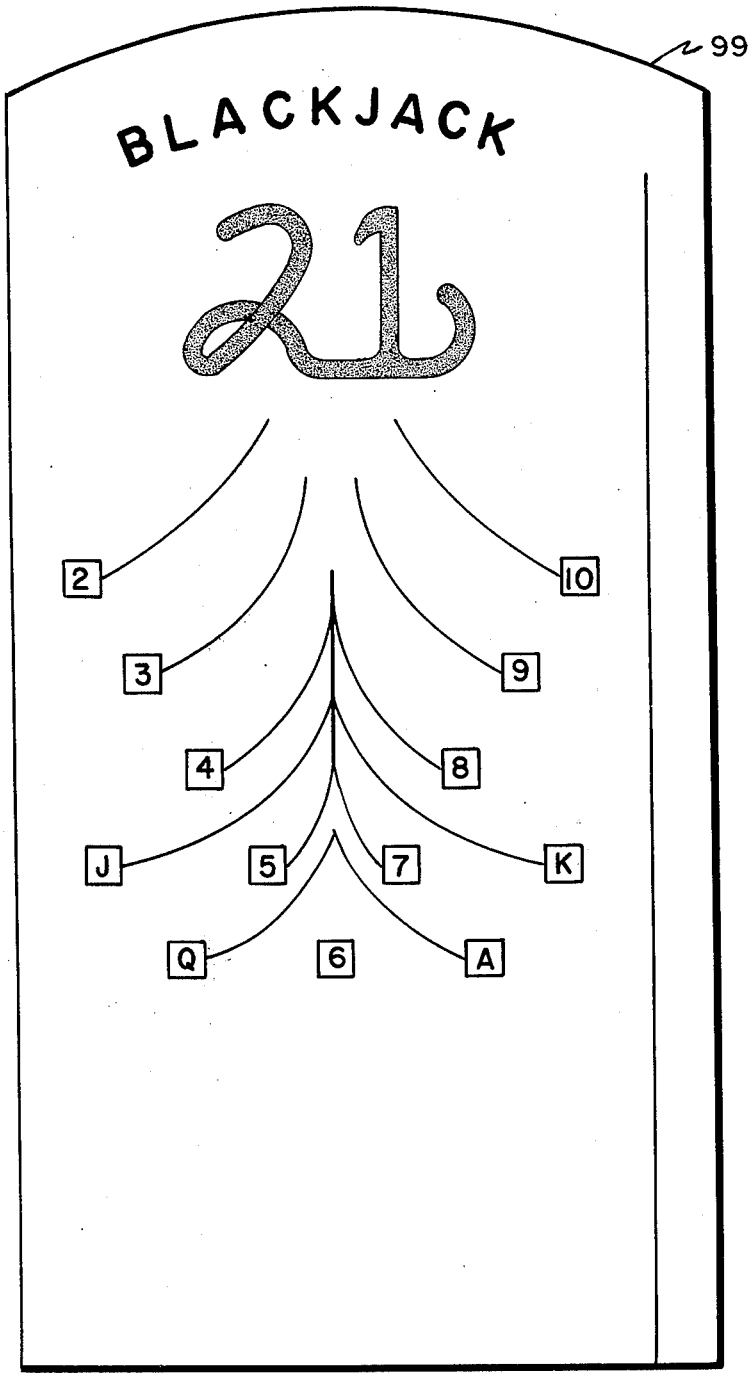
FIG. 16 is a top plan view of a blackjack field card.

In FIG. 16 there is shown a slot card 104 for use in playing a simulated game of skiball. The slot card 104 is provided with 13 marked areas 105 for alignment with the thirteen slots 66 and to indicate various numbers from 1 to 10 which are scores of a ball used in the playing of skiball.

Figure 17:
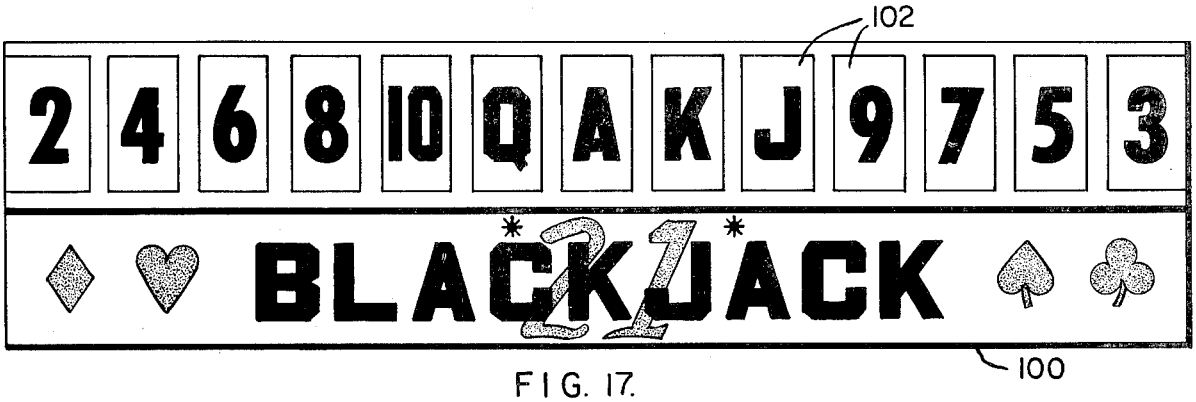
FIG. 17 is a top plan view of a blackjack slot card.

In FIG. 17 there is shown a slot card 100 for use in playing a simulated game of blackjack. The slot card 100 is provided with 13 marked areas 102 for alignment with the 13 slots 66 and to indicate the cards of a poker deck as is apparent from FIG. 17.

Figure 18:
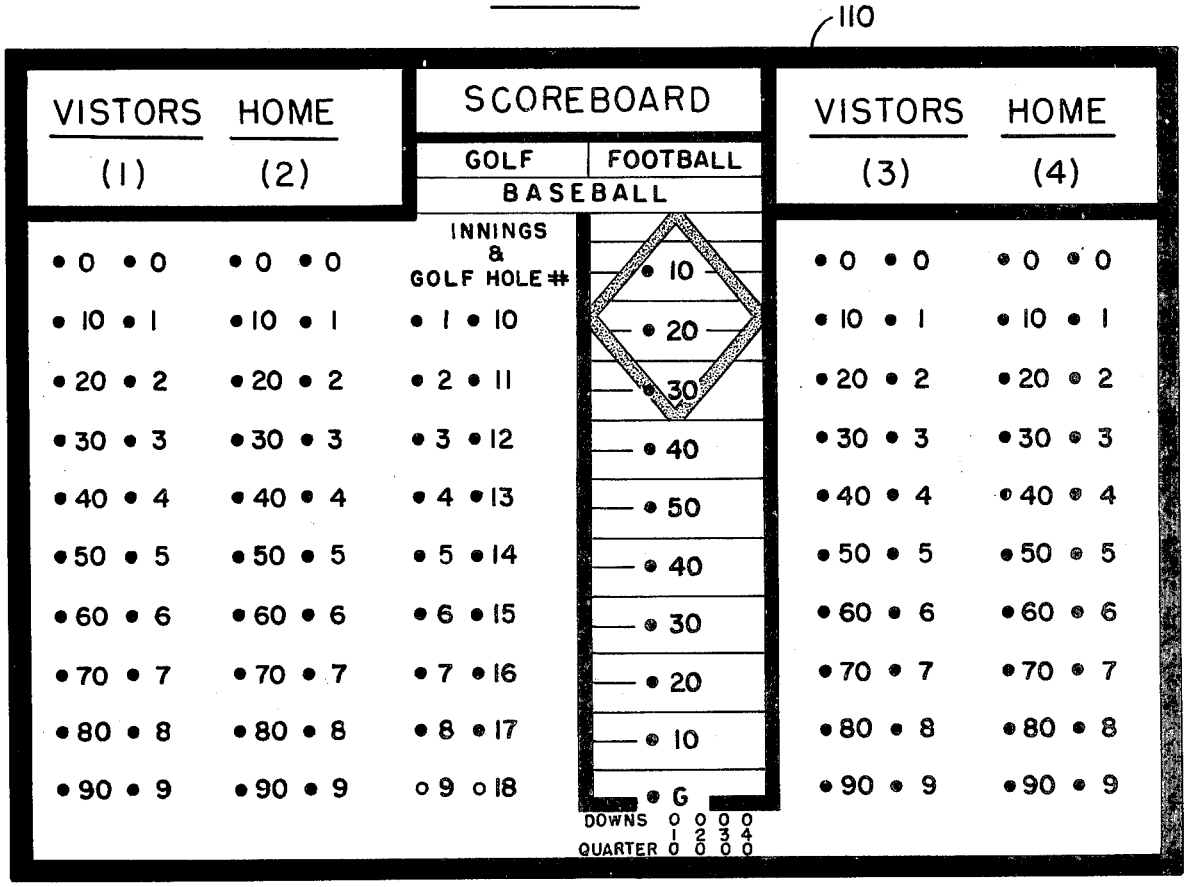
FIG. 18 is a top plan view of a scoreboard card.

In FIG. 18 there is shown a scoreboard 110 which can be used to keep score during the playing of the various games described above. The scoreboard has markings to indicate the score from 0 to 99 for four players, whether a player is on the visitor or home team, and the numbers from 1 to 18 which can be used to designate either the innings of a baseball game or the holes of a golf game. Also, there is provided a vertical column which shows the yardage markers of a football field and which shows superimposed thereupon a baseball diamond with the four bases. Suitable holes are provided in association with the various markings for receiving pegs so that the player can insert a peg to indicate a condition such as the score, the baseball inning or golf hole being played, the number of baseball players on the bases, or the yard line of a ball in a football game.

BASEBALL

The preferred rules to be used when playing a baseball game with the game apparatus in accordance with the invention are as follows:

1. The field card 70 and the slot card 72 are positioned on the game board 20. The game is started by flipping a coin to determine which player or operator is the home team. The winner of the flip may elect to be either the home team or the visiting team. The visiting team player will be the first at bat.

2. The home team player now decides where to put the eight defensive baseball players 60. The home team player may select either of the two holes 58 inside each of the circles 75 to put a defensive player 60. A defensive player must be put at each of the eight positions. The player for the team in the field is permitted to change the position of defensive players after each batter.

3. The regular rules of baseball are used, namely, there are nine innings per game and extra innings in the event of a tie game, and three outs per inning for each team at bat.

4. The visiting team player starts the game by shooting the ball into the playing field after all defensive players have been set in position. If the pin 62 of a defensive player stops the ball it is counted as an out. If the ball proceeds to pass all the defensive players 60 and enter one of the slots 66, the batter is credited with the event indicated in the aligned marked area 74 of the slot card 72. (EXAMPLE): If the ball goes into the middle slot 66 where the aligned marked area 74 of a slot card reads "HOME RUN", the player is credited with a home run and any players on base would score with the home run.

5. If the ball goes into the "RUNNER OUT TRYING TO STEAL" slot or the "SACRIFICE" slot when there are no runners on base, the batter is credited with a single.

6. If the ball gets stuck on its own and is not stopped by a defensive player, the play is started over.

HOCKEY

The preferred rules for the playing of a game of hockey with the game apparatus in accordance with the invention are as follows:

1. The field card 76 and the sot card 78 are positioned under the game board 20. Only one defensive player 82 is used. Any number of operators may play. The operator shooting subsequent to the actual shooter positions the defensive player 82, who represents a goalie, in one of the holes 58'.

2. A player keeps shooting until either the goalie stops the ball or the ball goes into one of the slots reading "SCORE" or "NO SCORE".

3. The first person to score six goals wins and the game is played for three periods. The first period ends when one player scores two goals, the second period ends when one player scores four goals, and the third period, and the game, ends when a player scores six goals.

FOOTBALL

The preferred rules for playing a game of football with the game apparatus in accordance with the invention are as follows:

1. The field card 84 and the slot card 86 are positioned under the game board 20. A coin is flipped to start the game and the winner may choose either to kick off or receive the kick. The operator kicking off then shoots the ball into the playing field and the ball travels through the field into one of the slots 66. The kicking player or operator is then credited with a kick to the yard line indicated in the vertical column aligned with the ball and the horizontal line associated with the "KICK OFF RETURN" marking 89.

1. The field card 84 and the slot card 86 are positioned under the game board 20. A coin is flipped to start the game and the winner may choose either to kick off or receive the kick. The operator kicking off then shoots the ball into the playing field and the ball travels through the field into one of the slots 66. The kicking player or operator is then credited with a kick to the yard line indicated in the vertical column aligned with the ball and the horizontal line associated with the "KICK OFF" marking 89. The kick receiving player then shoots the ball into the field and the ball is allowed to pass into one of the slots 66. The kick receiving player is credited with the return yardage indicated in the vertical column aligned with the ball and the horizontal line associated with the "KICK OFF RETURN" marking 89.

2. A ball marker is then placed on the yard line determined by the procedure of Rule (1) above, it being noted that the "KICK OFF RETURN" yardage is added to the point of the kick off. For example, if the "KICK OFF" slot indicates goal line after the kick off player has shot, and the return yardage is 25 after the kick return player has shot, then the ball is placed on the 25 yard line. A first down in flag-pin football is achieved each time an offensive player crosses the 20 yard markers. The markers are placed at the 20, 40, 40 and 20 yard lines.

3. The defensive player now inserts an eight man defense of the players 90 in openings 58 within the circled areas 85. One defensive man must be put in each circle 85.

4. The offensive player now tries to shoot the ball past all the defensive players and if this is done, the offensive player is credited with the yardage indicated in the horizontal line associated with the "YARDS GAINED" marking 89.

5. During the playing of the game, it is important that all the markers be moved. Thus, the down marker must be moved to the next hole unless an offensive team moves past the 20 yard markers or there is a penalty. Also, the play marker must be moved to the next hole. When the play marker reaches 20, a quarter is over. The ball marker is also moved to indicate the gain or loss on a play.

6. At the beginning of the second half, the team that received at the beginning of the game kicks off.

7. A field goal may not be tried more than 50 yards from the goal.

8. Anytime a pass interception or punt runback takes the ball over the goal line it is a touchdown.

9. Any punt that goes beyond the goal line is an automatic touchback and the ball is put in play at the 20 yard line.

10. When a penalty is against one team, the player for the other team can elect to either refuse the penalty and move the down marker to the next down or take the penalty and move the football the number of yards called by the penalty and there is no change of down.

11. All penalties, fumbles, interceptions and kick offs are decided without defensive players.

12. When the offensive team is stopped for a loss in its own end zone, it is a safety and the defensive team is credited with two points. The team that was stopped in its end zone must kick the ball from its own 20 yard line using the "PUNTS" and "PUNTS RETURN" yardage markers 89.

13. The only actions which do not result in advancing the "PLAY" marker are kick offs and point after touchdown kicks.

GOLF

In playing a game of golf with the game apparatus in accordance with the invention, the field card 92 and the slot card 94 are mounted on the game board 20 and the preferred rules of the game are as follows:

1. Golf can be played by one or more players by either total stroke or match play. The players alternate in shooting a ball into the field of play and are credited with the distance of number of putts shown on the slot card 94.

2. On any particular hole when a player needs less than 100 yards, add one stroke to his score and proceed to putt.

3. Any player who matches the yardage on a par three with the ball in the proper slot with the same yardage is awarded A hole-in-one.

4. A player is credited with an automatic one putt when he matches the yardage needed to reach the hole with the ball in the slot of the same yardage. For example, in hole number 1, which is 360 yards and a par four, if the first shot goes into the 200 yard slot and the second shot goes into the 160 yard slot, (total 360 yards), a player receives an automatic one putt and scores a birdie 3 for that hole.

BLACKJACK

In playing a game of blackjack with the game apparatus in accordance with the invention, the field card 99 shown in FIG. 16 and the slot card 100 shown in FIG. 17 are used and the following preferred rules of play are used:

1. The regular rules of blackjack are used. Three or more players can play this game. One player is the dealer and the dealer shoots the first ball to determine his first card. Then each of the other players shoot to detrmine their hand. For example, if one player has a hand with 10 points, he is entitled to another shot should he desire. Each player may continue to shoot until he decides when he has had sufficient points and he wishes to stop shooting.

2. Then the dealer shoots and takes as many shots as he desires. The rules of the game of blackjack apply. If the dealer goes over 21 he loses and all the other players with 21 or less win. If there is a tie score between the dealer and any other player, the dealer wins.

SKIBALL

In playing a game of skiball with the game apparatus in accordance with the invention, the field card 97 shown in FIG. 14 and the slot card 104 shown in FIG. 15 are used and the following preferred rules of the game apply:

1. Skiball can be played by one or more players in two versions. In the short version, the first player to score 50 points wins, and in the long version, the first player to score 100 points wins.

2. After deciding whether to play the long or short version of the game, each player or operator alternates turns shooting the ball into the playing field until one player has reached or exceeded the number of points for the game selected. During the play, the slot 66 which receives the ball indicates the credit to be given to the player by the associated number in the marked area 106 on the slot card 104.

I claim:

1. A game apparatus comprising: a game board, a ball, wall means on said game board extending around peripheral portions thereof and projecting upwardly from the top thereof to define a field of play in which said ball is confined, said game board being adapted to be set in an indicated position with one end of the field of play raised higher than the other end of the field of play, means on the upper surface of said game board defining a plurality of passageways for said ball extending from the upper end to said lower end of the field of play, said passageways including a plurality of intersections where said ball may take alternative paths, means for propelling said ball into the upper end of the playing field whereby said ball may move by gravity through said passageways to the lower end of the playing field, a cover mounted on said wall means to extend across said field of play, said cover having openings therein aligned with said alternative paths at said intersections, and a plurality of defensive players each of which includes a pin adapted to be extended through said openings in said cover into said alternative paths therebeneath to block the movement of said ball.

2. A game apparatus according to claim 1 in which said passageways are interconnected and include a plurality of entrances at the upper end of said field of play and a plurality of exits at the lower end of said field of play.

3. A game apparatus according to claim 2 wherein each passageway is provided with at least three intersections, and there are provided a greater number of exits than entrances.

4. A game apparatus according to claim 3 including means providing a row of slots at the lower end of said playing field for receiving and holding a ball which has passed through said playing field.

5. A game apparatus according to claim 1 including means for indicating the game to be played, said game being one of a variety of games.

6. A game apparatus according to claim 1 wherein said game board and said cover are made of a transparent material and including a plurality of playing field cards adapted to be mounted on the game board and provided with markings illustrative of a particular game, said markings being visible from the top of the game apparatus.

7. A game apparatus according to claim 6 including a plurality of slot cards, means for positioning said slot cards adjacent to and extending along said row of slots, said slot cards having marked areas for alignment with said slots to indicate various values or events assigned to each slot, whereby when a ball enters a particular slot during the playing of a game, the player receives credit for the assigned value or event indicated by the aligned slot.

8. A game apparatus according to claim 7 wherein said means for propelling said ball into the upper end of the field of play comprises a spring biased plunger located at the lower end of the game board adjacent to one side edge thereof, and a guideway through which said ball may roll extending along said one side edge from said plunger to the upper end of the field of play.

9. A game apparatus according to claim 8 in which said passageways are interconnected with one another and include a plurality of entrances at the upper end of said field of play and a plurality of exits at the lower end of said field of play, each of said passageways being provided with at least three intersections.

10. A game apparatus according to claim 9 including field of play cards marked to simulate a baseball field, a football field, and a hockey rink, and including defensive players having the configuration of baseball, football and hockey players.

11. A game apparatus according to claim 10 including a slot for use in playing a simulated game of baseball with the game apparatus having markings indicating various types hits and outs, a slot card for use in playing a simulated game of football with the game apparatus having markings indicating various events that occur during the playing of a football game, including yards gained, field goal, punt yardage, punt return yardage, kick-off yardage, kick-off return yardage, interceptions, fumbles, penalties and extra points, and a slot card for use in playing a simulated game of hockey with the game apparatus having markings indicating the scoring of a goal, the non-scoring of a goal, and extra shots.

12. A game apparatus according to claim 11 including a field of play card marked to simulate a golf course, a slot card for use in playing a simulated game of golf with the game apparatus comprising indications of the yardage distance of a golf stroke and the number of putts, a slot card for use in playing a simulated game of skiball with the game apparatus provided with markings to indicate various numbers of the points from 1 to 10, and a slot card for use in playing a simulated game of blackjack with the game apparatus including markings to indicate various cards of a poker deck.

* * * * *